United States Patent [19]

Fujii et al.

[11] Patent Number: 4,734,740

[45] Date of Patent: Mar. 29, 1988

[54] IMAGE FORMATION METHOD AND APPARATUS

[75] Inventors: Motoharu Fujii, Tokyo; Takao Muramatsu, Yokohama; Noboru Koumura, Tokyo; Susumu Sugiura, Yamato; Nobuhiro Takekawa, Tokyo; Syusei Tsukada, Sagamihara, all of Japan

[73] Assignee: Canon Kabushiki Kaisha, Tokyo, Japan

[21] Appl. No.: 858,082

[22] Filed: Apr. 28, 1986

Related U.S. Application Data

[63] Continuation of Ser. No. 542,074, Oct. 14, 1983, abandoned, which is a continuation of Ser. No. 296,324, Aug. 26, 1981, abandoned, which is a continuation of Ser. No. 63,430, Aug. 3, 1979, abandoned, which is a continuation of Ser. No. 760,257, Jan. 18, 1977, abandoned.

[30] Foreign Application Priority Data

Jan. 26, 1976 [JP] Japan ..... 51-7749

[51] Int. Cl.[4] ..... G03G 15/06; G03G 15/22; G03G 21/00

[52] U.S. Cl. ..... 355/14 R; 355/140

[58] Field of Search ..... 355/3 R, 3 DD, 4, 14 R, 355/14 D, 14 CH; 118/645, 646

[56] References Cited

U.S. PATENT DOCUMENTS

| | | | |
|---|---|---|---|
| 3,438,705 | 4/1969 | King | 355/14 |
| 3,782,818 | 1/1974 | Smith | 355/3 R X |
| 3,788,739 | 1/1974 | Coriale | 355/3 R X |
| 3,877,413 | 4/1975 | Rowell et al. | 355/14 D X |
| 3,918,971 | 11/1975 | Zweig | 355/3 R X |
| 4,000,944 | 1/1977 | Fraser | 355/14 |
| 4,003,650 | 1/1977 | Courtney et al. | 355/14 |
| 4,032,227 | 6/1977 | Hubbard et al. | 355/14 D X |
| 4,050,806 | 9/1977 | Miyakawa et al. | 355/14 |
| 4,069,759 | 1/1978 | Endo et al. | 101/467 |
| 4,087,171 | 2/1978 | Yano | 355/14 |

*Primary Examiner*—Fred L. Braun

*Attorney, Agent, or Firm*—Fitzpatrick, Cella, Harper & Scinto

[57] ABSTRACT

An image formation apparatus includes an electrostatically chargeable member having an optical density that changes with change of its reproducing power. A charging device forms an electrostatic latent image on the chargeable member, and a developing device develops the electrostatic latent image into a visual image. A transfer mechanism then transfers the visual image onto a recording member. A detector detects the optical density before the chargeable member is charged by the charging device and a control device controls at least one of the charging device, the developing device, and the transfer mechanism in accordance with the output of the detector.

31 Claims, 18 Drawing Figures

TO DISCHARGER
TO DEVELOPING MEANS
HVT1
HVT2
CPY
MM1
MM2
STP
FF3
G13
G12
G11
G14
SW1
SW2
K
Z2
Z3
114
115
113
119
208
C P U
209
OUT 1
OUT 2
OUT 3
210
D/A
207
IN
206
A/D
205
211
212
IN 2
RESET
SET2
SET1
STP
STR
PH A
PH B

IMAGE FORMATION METHOD AND APPARATUS

This application is a continuation of application Ser. No. 542,074 filed Oct. 14, 1983, now abandoned, which was a continuation of appln. Ser. No. 296,324, filed Aug. 26, 1981, now abandoned; which was a continuation of appln. Ser. No. 063,430, filed Aug. 3, 1979, now abandoned; which was a continuation of appln. Ser. No. 760,257, filed Jan. 18, 1977, now abandoned.

BACKGROUND OF THE INVENTION

1. Field of the Invention

This invention relates to an image formation method using electrostatic printing and an apparatus therefor, and more particularly to an image formation capable of controlling the image density and an apparatus therefor.

2. Description of the Prior Art

Recently, in the field of printing or recording, remarkable advancements have been seen in the development of higher-speed, simple and accurate recording or printing methods and further in the development of the materials used therefor. Among them, the thermosensitive photosensitive medium composed chiefly of organic silver salt eliminates the necessity of being subjected to the wet development and fixing process after exposure to an image light as has been the common photographic material sing inorganic silver salt, and this is one of the materials which have especially received attention. That is, the thermosensitive photosensitive medium composed chiefly of organic silver salt permits the adoption of the so-called dry development which can accomplish development simply by heating that medium after it has been exposed to image light in a conventional manner. Therefore, as compared with the cases where wet development is required, this medium is advantageous in that the processing liquid for development and fixation is not required and development can be accomplished simply by applying heat to the material after the image exposure has been applied thereto and moreover, there is no necessity of fixation in particular.

The thermosensitive photosensitive medium may usually comprise a back-up member such as a film or sheet of plastic or paper or like material and an image formation layer chiefly of organic silver salt provided on said back-up member as by coating or like means. More particularly, such photosensitive medium may be obtained by dispersing organic silver salt, reducing agent and a small amount of halide with respect to the organic silver salt through a binder such as electrically insulative material and providing these materials on the back-up member. The thermosensitive photosensitive medium so composed may be subjected to image exposure, whereafter (or simultaneously therewith) it may be heated and developed to form a silver image thereon. The electrostatic printing is to electrostatically produce printed matter by using the photosensitive medium prepared in the manner described above. Typical organic silver salts unable for such photosensitive medium include organic acid silver salts such as silver behenate, silver arachidate, silver stearate, silver palmitate, silver myristate, silver laurate, silver caprylate, silver uranate, silver hydroxystearate, silver acetate, etc.; and organic silver compounds such as silver benzoate, silver phthalazinone, silver benztriazole, silver saccharin, silver 4-n-octadecyloxydiphenyl-4-carboxylate, silver-0-aminobenzoate, silver-acetoamidobenzoate, silver furoate, silver camphorate, silver p-phenylbenzoate, silver phenyl acetate, silver salicylate, silver butyrate, silver terephthalate, silver phthalate, silver acid pathalte, etc.

The reducing agent includes hydroquinone, methylhydroquinone, chlorohydroquinone, bromohydroquinone, catechol, pyrogallol, methylhydroxynaphthalens, aminophenol, 2,2'-methylene bis(6-t-butyl-4-methylphenol), 4,4'-butylidone bis(6-t-butyl-3-methylphenol), 4,4'-bis(6-t-butyl-3-methylphenol), 4,4'-thio bis(6-t-butyl-methylphenol), 2,6-di-t-butyl-p-cresol, 2,2'-methylene bis(4-ethyl-6-t-butylphenol), phenidone, metol, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, or bis(2-hydroxy-1-naphthyl) methane, or a mixture thereof. The halides for imparting photosensitivity to the organic silver salt include various inorganic halides (X=Cl.Br.I) such as $NH_4X$, $CrX_2$, $IrX_4$, $InX_4$, $CoX_2$, $CdX_2$, KX, HX, $SnX_2$, $SnX_4$, $SrX_2$, $SO_2X_2$, $TiX_3$, $TiX_4$, $CuX_2$, NaX, $PbX_2$, $NiX_2$, $PdX_2$, $MgX_2$, $Al_2X_2$, $MnX_2$, $BaX_2$, $KAuX_4$, $HAuCl_4$, $BiX_3$, CsX, $FeX_3$, AgX, etc.

The action and mechanism of the above-mentioned halides contributing to the image formation can not fully accurately be explained as yet, whereas among these halides, silver halide is known as a substance which produces free silver upon exposure to light, said free silver forming a developing core during development and expediting the liberation of silver from organic silver salt to form a silver image. As regards the other halides than silver halide, these react to organic silver salt during the formation of the thermosensitive photosensitive medium to create silver halide and when exposed to light, the silver halide produces free silver as already described, and such free silver forms a developing core to form a silver image on the exposed portion.

The insulative medium may suitably be any of various resins such as polystyrene resin, polyvinyl chloride resin, phenolic resin, polyvinyl acetate resin, polyvinyl acetal resin, epoxy resin, xylene resis, alkyd resin, polycarbonate resin, polymethyl methacrylate resin, polyvinyl butyral resin, gelatin resin, polyester, polyurethane, synthetic rubber, polybutene, polyvinyl acetate, etc.

A plasticizer may be added, as required. The plasticizer may be dioctyl phthalate, tricresyl phosphate, diphenyl chloride, methyl naphthalene, p-terphenyl, diphenyl or the like.

The electrostatic printing process using such photosensitive material comprises first charging the photosensitive medium to form thereon an electrostatic latent image corresponding to the silver image, developing such electrostatic latent image into a toner image, thereafter transferring the toner image to a transfer medium and fixing the toner image.

The quantity of charge imparted during the step of charging is determined by the charge-retaining power of the silver image portion produced by subjecting the thermosensitive photosensitive medium to the exposure and heating steps, and the charge retaining power may be taken as the electrical resistance, the electrostatic capacity or the photographic density of the silver image portion. More specifically, if the electrical density is small, the charge retaining power may be said to be great. As already described, if the charge retaining power is always constant under a predetermined exposure and a predetermined heating condition, each step in the electrostatic printing may be fixed to a predetermined condition.

However, one of the characteristics of the thermosensitive photosensitive medium is that it can not always have a constant charge retaining power in spite of being subjected to a predetermined exposure, under the influence of the environment in which it is stored, the influence of the temperature and humidity at which it is used, and the influence of the instability of the heat source during the heating step. Therefore, if the charge retaining power is greater than a value expected, a greater quantity of charge will be retained by such photosensitive medium due to charging, so that a greater quantity of toner will be deposited on the medium during the step of toner development. Should the portions of the photosensitive medium on which toner should not be deposited have a greater charge retaining power from such a cause, these portions will be developed during the step of toner development, thus resulting in deposition of toner on these portions, namely, creation of fog which will mean stained printed matters.

Conversely, a smaller charge retaining power would undesirably fail to provide the toner image with a contrast.

SUMMARY OF THE INVENTION

It is an object of the present invention to eliminate the above-noted disadvantages and to provide an image formation method which is enhanced in speed and operability and an apparatus therefor.

It is another object of the present invention to provide an image formation method which ensures formation of appropriate visible images and an apparatus therefor.

It is still another object of the present invention to provide an image formation method which ensures formation of fogless visible images with a constant contrast irrespective of the properties of the master, and an apparatus therefor.

It is yet still another object of the present invention to provide an image formation method which eliminates production of useless printed matter by stepping the printing process when printing is impossible because of the properties of the master, and an apparatus therefor.

It is also an object of the present invention to provide an image formation method having image density regulating means best suited for the electrostatic printing in which an electrostatic latent image formed on an organic silver salt master is developed into a toner image which is in turn transferred to a transfer medium, and an apparatus therefor.

According to the present invention, operation of the image formation processing means is controlled in accordance with the charge retaining characteristic of the photosensitive medium to thereby produce visible images having a desired density.

The invention will become more fully apparent from the following detailed description thereof taken in conjunction with the accompanying drawings.

BRIEF DESCRIPTION OF THE DRAWINGS

FIG. 13-1 diagrammatically shows a discriminating circuit according to the present invention.

FIG. 13-2 diagrammatically shows switch actuating circuitry according to the present invention.

DESCRIPTION OF THE PREFERRED EMBODIMENTS

The invention will hereinafter be described with respect to an example of the electrostatic printing apparatus of the image transfer type using a photosensitive master composed chiefly of organic silver salt.

Figure 1:
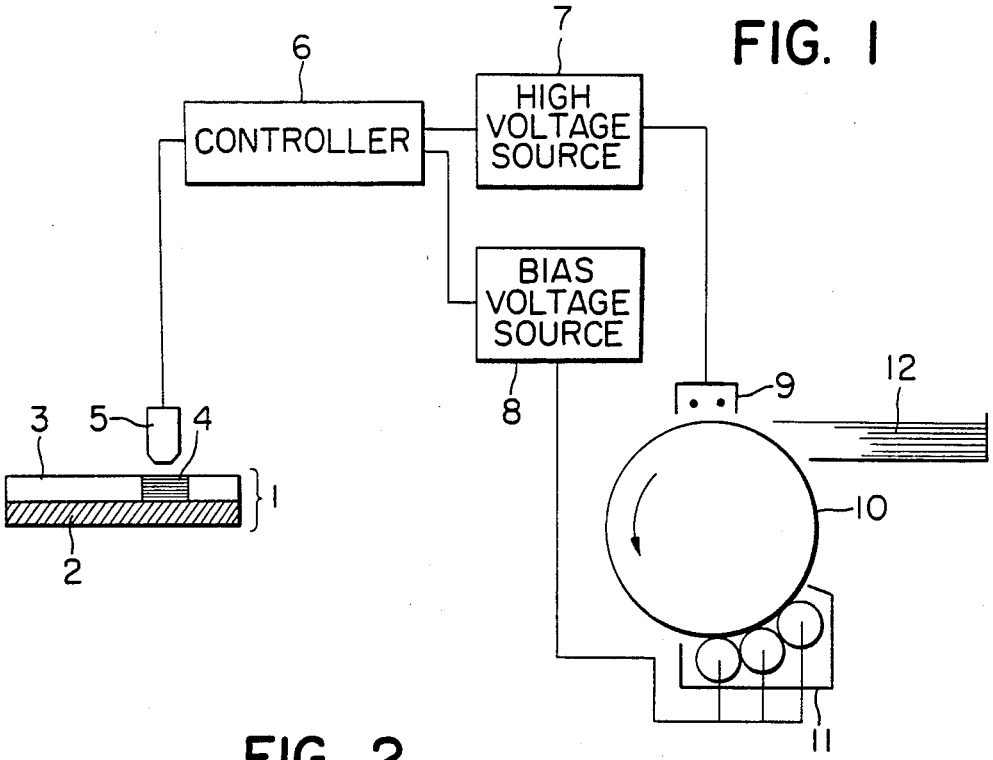
FIG. 1 is a schematic view showing the electrostatic printing method embodying the present invention.

FIG. 1 schematically shows the image density control method in such apparatus. In FIG. 1, reference numeral 1 designate a heat-developable photosensitive sheet member comprising a back-up member 2 and a photosensitive layer 3. A reference exposure section 4 subjected to a predetermined quantity of exposure and heating is measured by a photographic density measuring device 5. The measurement of the photographic density is effected by measuring the reflection density if the back-up member 2 is an opaque material. If the back-up member 2 is a transparent material, the measurement of the transmission density is also possible. The signal from the photogrphic density measuring device 5 is directed to a control device 6, which delivers instructions for appropriate charging voltage and developing bias voltage to a high voltage source 7 and a bias voltage source 8, respectively. The heat-developable photosensitive sheet member 1 or the master for electrostatic printing is mounted on a drum 10 and charged with an appropriate charging voltage by a charger 9, whereafter the master is developed by a toner developing device 11 having an appropriate bias voltage applied thereto, and then the image developed on the master is transferred to a sheet of transfer paper 12 simultaneously with the next charging step.

In the above-described method, the charge retaining property is measured in terms of the photographic density on the reference exposure section, but it is also possible to adopt a method whereby the charge retaining property is measured in terms of electrical resistance or electrostatic capacity to control the charging voltage and the developing bias voltage.

In order that electrostatic prints having a predetermined reflection density may be obtained regardless of the difference in charge retaining power of the master, the reflection density in the exposed portion of the master may first be measured. Thus, the process speed of the master having its reflection density known is determined and the charging voltage is determined, whereby the available surface potential (fog potential or contrast) of the master is determined. Once the surface potential is determined, the density of the image printed is determined by the developing conditions.

Figure 2:
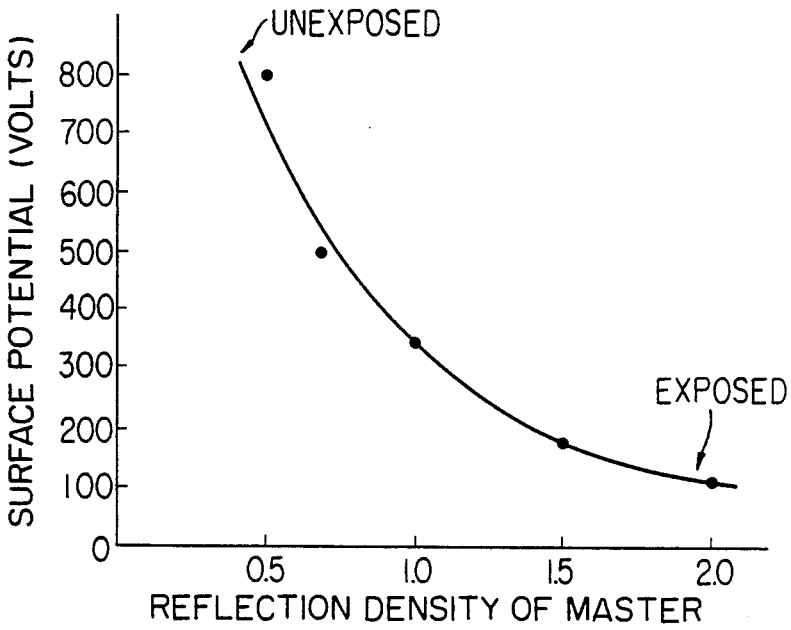
FIG. 2 is a graph illustrating the relation between the density and the surface potential of the master.
Figure 3:
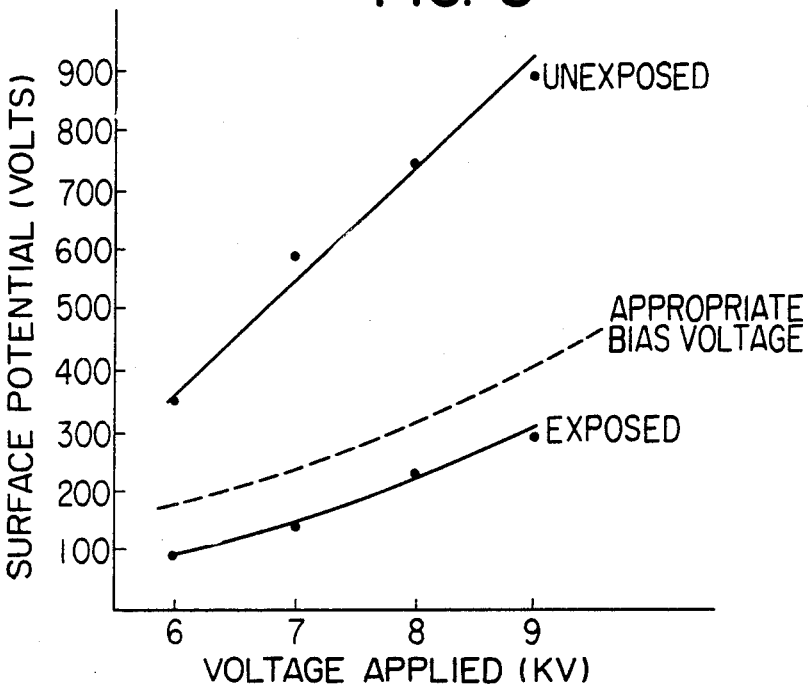
FIG. 3 is a graph illustrating the relation between the voltage applied to and the surface potential of the master.
Figure 4:
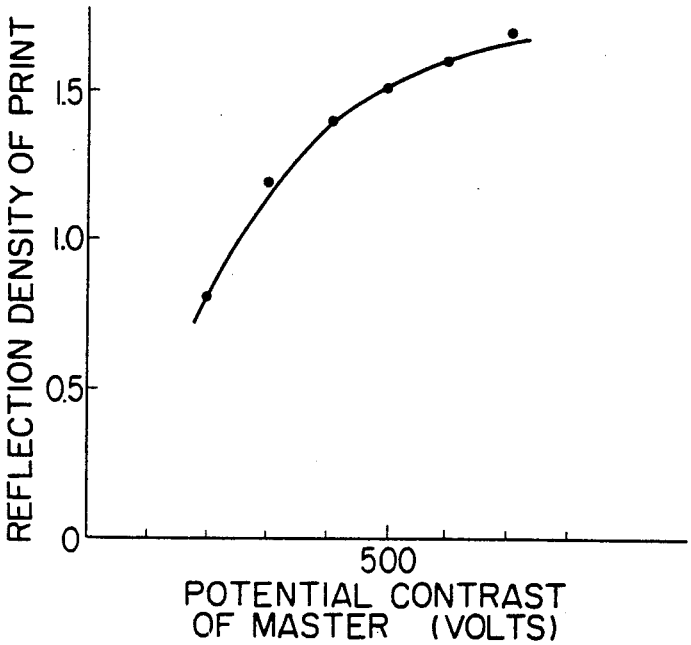
FIG. 4 graphically illustrates the relation between the contrast potential of the master and the density of print.

These relations are exemplarily shown in FIGS. 2, 3 and 4. As seen there, the reflection density of the master is measured to thereby effect regulation of the developing bias voltage and the charging voltage, thus enabling electrostatic prints having a predetermined image density to be provided irrespective of the difference in characteristic of the master.

FIG. 2 illustrates the relation between the reflection density of the master and the surface potential thereof provided when the master is subjected to corona charge (with a voltage of 8 KV applied and the master fed at a speed of 100 cm/s). As seen from the graph of FIG. 2, a higher reflection density results in a lower potential.

FIG. 3 illustrates the relation between the applied charging voltage and the surface potential on the master where the feeding speed of the master is 100 cm/s.

According to this graph, an increased voltage applied results in an increased contrast and also accompanies an increased fog potential, and therefore it becomes necessary to regulate the developing bias if the applied voltage is varied to eliminate the fog.

FIG. 4 illustrates the relation of the potential contrast between the exposed and the unexposed portion with the print density provided by effecting appropriate bias development and toner development. cl EXAMPLE 1

20 grams of silver behenide, 150 grams of methyl ethyl ketone and 150 grams of toluen were mixed together and crushed in a ball sill for 72 hours to form uniform slurry. Subsequently, 100 grams of solution of polyvinyl butylal resin (produced and sold by Sekisui Kagaku Co., Ltd. under the tradename of ESLECK BM-11) in 20% by weight of ethyl alcohol was added to the slurry and gently mixed together for 3 hours. Next, 0.12 gram of mercury acetate, 0.2 gram of calcium bromide and 5.0 grams of phthalazinon were successively added to prepare a photosensitive material. This was uniformly applied over an aluminum plate of 100μ thickness by means of a coating rod, and dried at 80° C. for 3 minutes.

Further, a mixture of 1.5 grams of 2,2' methylenebis-6-t-butyl-p-cresol, 0.3 gram of phthalazinon, 100 grams of solution of cellulose acetate (tradename: DYECELL-30) in 10% by weight of acetone, 15 grams of acetone and 0.005 gram of sensitizing pigment

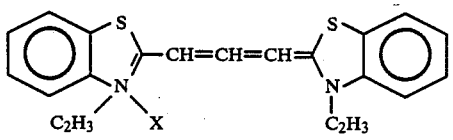

was applied over the above-described layer of silver behenide. All these procedures were carried out in the dark.

Such a photosensitive plate was subjected to exposure for 2 seconds by the use of a tungstem light source (60 luxes) with a positive image interposed therebetween, whereafter the photosensitive plate was heated at 130° C. by a roller type heating device for 2 seconds and for 3 seconds, respectively, whereby there were obtained two types of negative printed visible images.

The reflection densities of these masters in their exposed portions were 1.2 for 3 seconds of heating and 0.8 for 2 seconds of heating. At the same time, the reflection density in the unexposed portion was of the order of 0.4 and little varied even if the density in the exposed portion was varied.

When corona charge was imparted to these masters by a source voltage of 8 KV, the contrast obtained was 540 V for the density 1.2 and 350 V for the density 0.8.

When toner development was carried out with such contrasts, the print densities obtained were such that the reflection density was 1.6 for 540 V and 1.3 for 350 V. To eliminate such a difference in density and unify the density to any one of the two densities, the source voltage for corona charge to the master of 540 V was varied to 6.7 KV, whereby there was obtained a print density substantially identical with that of the master when the contrast was 350 V. In this case, the proper developing bias voltage was of the order of 210 V, which means that a voltage lower by about 100 V than that for the contrast of 540 V is a proper value.

The step of charging in the electrostatic printing may be accomplished as by passing the photosensitive medium under a positive or a negative corona electrode or by using a contact electrode. The step of development may be effected for toner treatment by any commonly used method such as cascade development, magnetic brush development, liquid development, magnedry development or water development. The step of transfer may also be accomplished by bringing a transfer member such as paper into contact with the surface of the master carrying a toner image thereon and using a corona electrode opposite in polarity to the toner, namely, different in polarity to that used in the charging step, to charge the transfer member from behind it to thereby transfer the toner image to the transfer member. The toner image so transferred may be fixed by a well-known technique which may be, for example, heat-fixation, solvent-fixation or pressure-fixation.

Figure 5:
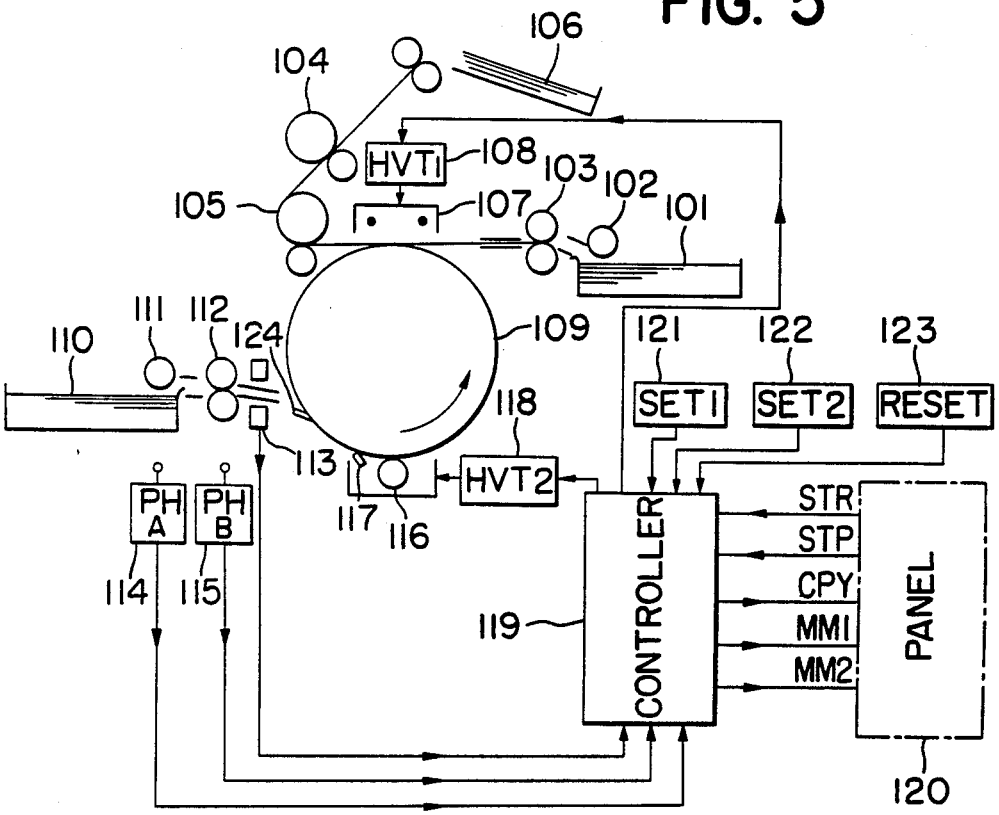
FIG. 5 schematically shows an electrostatic printing apparatus to which the present invention is applied.

FIG. 5 schematically shows an electrostatic printing machine using a master.

A master 110 having an image developed in advance by a master forming device (not shown) is fed to a drum 109 by means of a pick-up roller 111 and transport rollers 112. The drum grips the master by means of a gripper 124, which secures the master to the drum. Corona charge is uniformly imparted from a charger 107 to the master secured to the drum. An electrostatic latent image is formed on the master in accordance with the image density thereon. If the output of a high voltage transformer (HVT1) 108 is of the positive sign, a latent image having positive charge will be formed on the master. If toner of the negative polarity is contained within a developing device 116, the toner will be deposited onto the master by the positive charge thereon, thus forming an image. On the other hand, a sheet of printing paper 101 is fed by a pick-up roller 102 and transported to an image transfer station by paper transport rollers 103. Since the printing paper is uniformly charged to the positive polarity from the back thereof by the high voltage transformer HVT1, the negative toner is transferred to the printing paper while, at the same time, the drum is again charged to the positive polarity. After the image transfer, the printing paper passes through a fixing device 104 onto a paper discharge tray 106. The master is cleaned by a cleaning blade 117 to remove any residual toner therefrom, thus becoming ready for reuse.

It is seen in the graph of FIG. 3 that as the applied voltage is increased, the contrast potential (the surface potential on the unexposed portion minus the surface potential on the exposed surface portion) is increased and accordingly, the surface potential on the exposed portion is also increased. Consequently, what is called the fog is created when development is effected. Thus, the printing paper is generally stained. If the voltage represented by the dotted curve in the graph of FIG. 3 is applied as a bias voltage to the developing device, the toner for the surface potential on the unexposed portion will be deposited on the master but the toner for the exposed portion will remain in the developing device and never be deposited on the master. Thus, the above-noted disadvantage may be compensated for by the application of a proper bias to the developing device.

In the electrostatic printing machine using a master, it will thus be seen that the print is fogged or a sufficient amount of toner fails to be deposited on the unexposed portion depending on the quality of the master, but these may be automatically corrected in a manner described hereinafter.

Figure 6:
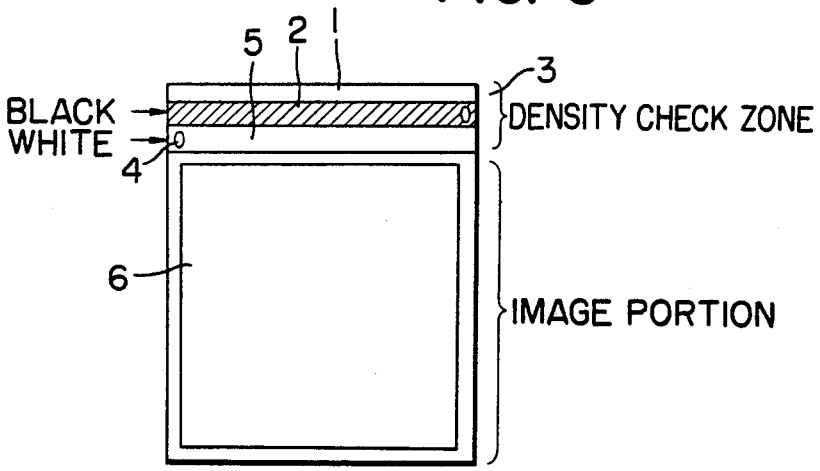
FIG. 6 is a plan view of the master according to the present invention.

FIG. 6 shows a master provided with a reference density region (hereinafter referred to as the check zone). More specifically, a light portion (the black portion indicated by 2) and a dark portion (the white portion indicated by 5) are formed on the check zone by a fixed pattern provided on a master forming device. The master image portion formed by such check zone appears as the result which contains all the variable factors such as the quantity of exposure in the master forming device, the temperature of the heat developing device, the characteristic of the material forming the master, etc.

The bias voltage for the developing device is determined by detecting the reflection density on the light portion 2, and the voltage applied to the charger is determined by detecting the reflection density of the dark portion 5. Also, where the reflection density of the dark portion becomes lower than a predetermined value or the reflection density of the light portion becomes higher than a predetermined value, depending on the quality of the master, the light-and-dark contrast becomes too low for sufficiently good images to be formed even if the master is applied to the printing machine. In such cases, interlock is applied to prevent the printing process from being entered.

In FIG. 5, reference numeral 119 designates an automatic voltage setting control circuit which will later be described. Denoted by 120 is a printer control section (hereinafter referred to as the panel section). A print start signal (STR) and a print stop signal (STP) are supplied from the panel section 120 to the control section 119. On the other hand, a print start instruction signal (CPY), a master contrast density abnormality signal A (the dark portion is too light—MM1) and a master contrast density abnormality signal B (the light portion is too dark—MM2) are sent from the control section 119 to the panel section 120. These abnormality signals turn on an alarm lamp in the panel section to inform the operator of the abnormality and also effect interlock so that the printing process may not be entered. Designated by 121 and 122 are setters SET1 and SET2 for setting the limits of the abnormality of the master density. SET1 is a switch for setting the limit of the density abnormality in the dark portion and SET2 is a switch for setting the limit of the density abnormality in the light portion. Denoted by 123 is a reset switch REST by which the operator may release the interlock after having removed the abnormal master whenever the master density is abnormal. Numeral 113 designates a photoelectric converter for measuring reflection density in the check zone of the master, which converter may be a photodiode capable of receiving the reflected light from a light emitting diode and converting it into an electric current. Designated by 114 (PH-A) and 115 (PH-B) are photodiodes for detecting the positions of the light and the dark portion of the check zone (FIG. 5) of the master. The signals from these provide synchronous timing signals for detecting the densities only on the light and dark portions.

When the printer is started with the density limits SET1 and SET2 being set and with the preparations for printing being complete, the signal STR is supplied to cause the pick-up roller 111 to feed a master 110. When the master has passed between the transport rollers 112, the master check zone detector 114 and 115 disposed between the rollers 112 and the drum 109 informs the control section 119 that the portion to be checked has come to below the reflection density detector 113.

Figure 12:
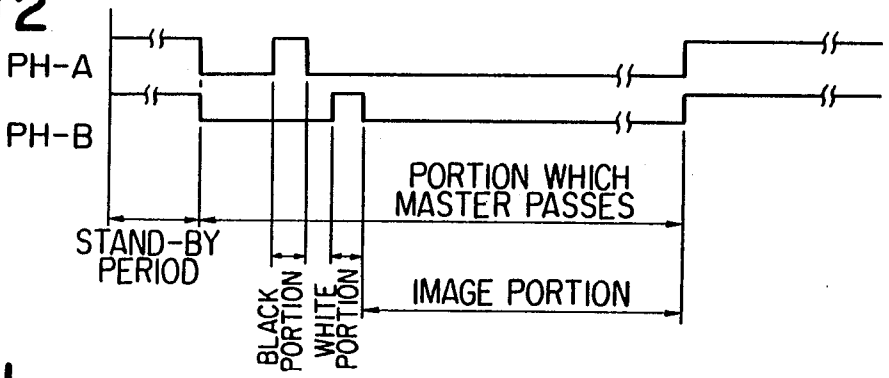
FIG. 12 illustrates the check zone detection signals.

If cut-aways 3 and 4 are provided to the master density check zone, PH-A and PH-B will become such output signals as shown in FIG. 12. When PH-A is at "H" level and PH-B is at "L" level, it means that the light portion of the density check zone of the master lies below the reflection density detector 113, and when PH-A is at "L" level and PH-B is at "H" level, it means that the dark portion of the master lies below the reflection density detector 113. Thus, the densities of the light and dark portions of the master are discretely detected as the master passes through the check zone. Voltages for various printing process means are set in accordance with the detected densities and the process execution from the formation of electrostatic latent image to the transfer thereof is repeated. After a predetermined number of prints has been completed, the process execution is stopped and the work of discharging the master is undertaken.

Figure 7:
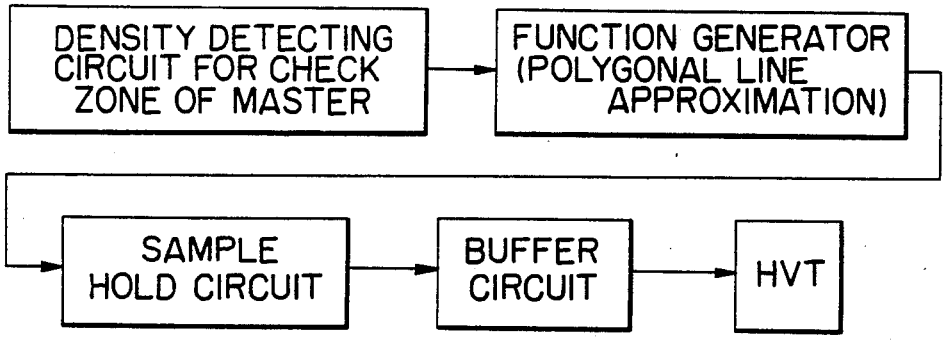
FIG. 7 is a block diagram illustrating the density control method according to the present invention.

FIG. 7 is a block diagram of a control circuit for setting the voltages for the process means by the use of an analog circuit.

Figure 9:
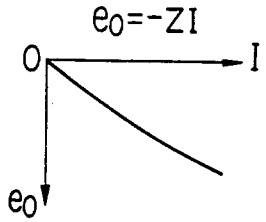
FIGS. 9 and 10 are graphs illustrating the voltage characteristics of the FIG. 8 circuit.
Figure 10:
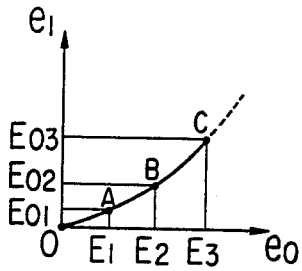
Figure 8:
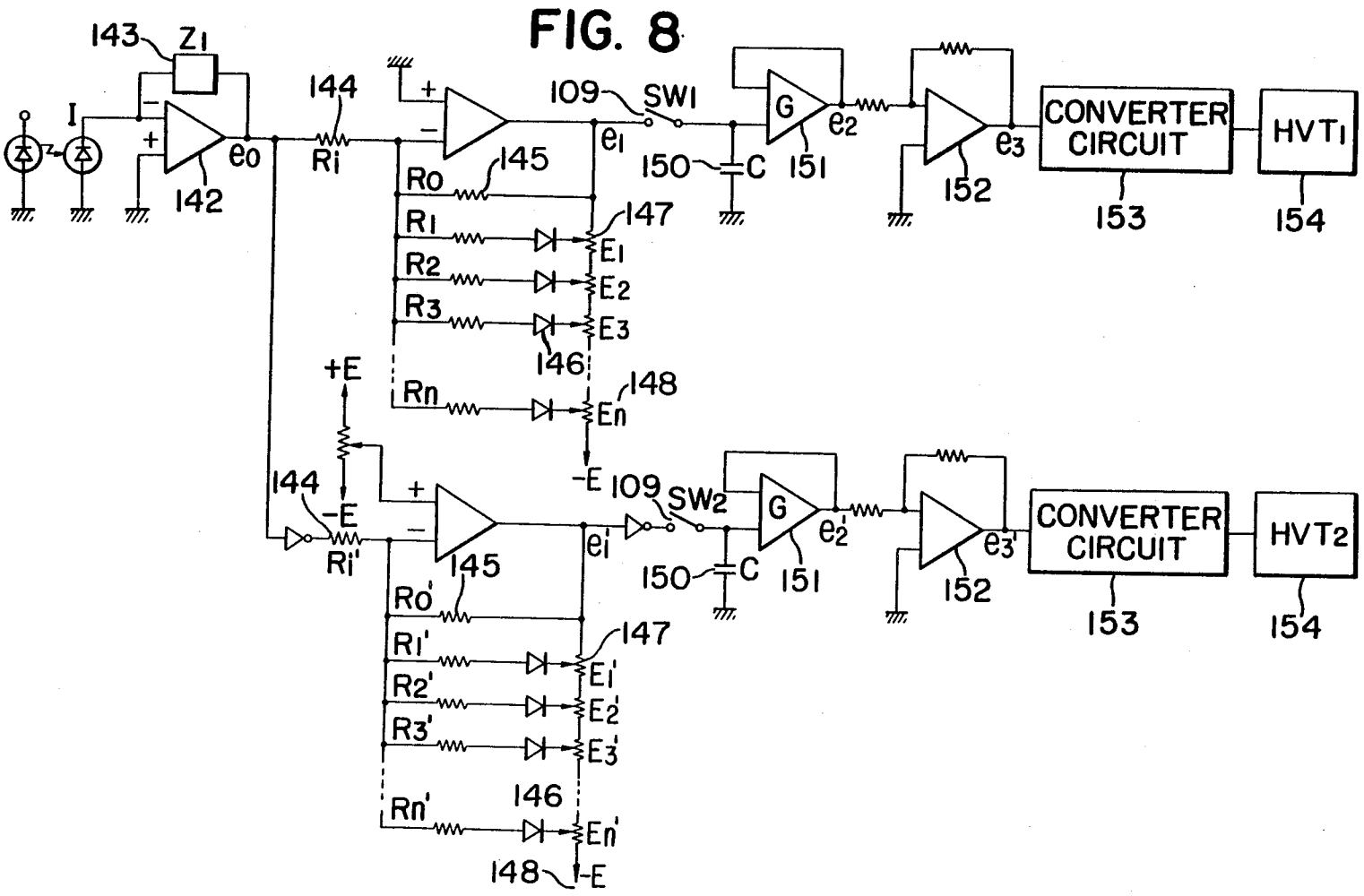
FIGS. 8 and 13 diagrammatically show examples of the density control circuit according to the present invention.

FIG. 8 shows a specific example of a circuit based on the block diagram of FIG. 7. FIGS. 9 and 10 illustrate the operation of the FIG. 8 arrangement.

The light receiving element 113 detects the quantity of reflection light on the master check zone. By an operational amplifier 142, the output voltage $e_0$ is made proportional to the quantity of input light to the light receiving element 113, so that there is produced an output $e_0 = -ZI$, where I is the short-circuiting current for the light receiving element which is produced in proportion to the quantity of light. When the reflection density on the master check zone is obtained, the charger voltage and the bias voltage to be actually applied are determined by the reflection density vs. appropriate applied voltage characteristic curve which is empirically determined. Such function is performed by a function generator which will hereinafter be described.

Figure 11:
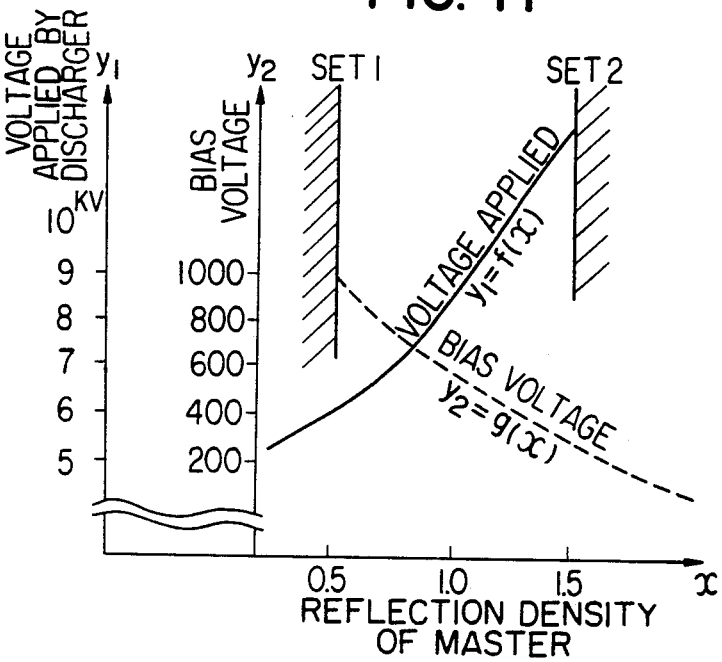
FIG. 11 is a graph illustrating the density/charger voltage/bias voltage characteristic.

The circuit from the function generator to the output port will now be discussed in conjunction with the circuit for setting the charger voltage. The function generator comprises an input resistor R1 144, a group 145 of feedback resistors $R_0$, $R_1$, $R_2$, . . . , $R_n$, a group 146 of diodes, a group 147 of variable resistors, a stabilizing power source 148 and operational amplifiers. FIG. 10 illustrates the relation between the input voltage $e_0$ and the output voltage $e_1$. As seen, when $e_0$ is zero, the output $e_1$ is also zero and therefore, the voltages at points $E_1$, $E_2$, $E_3$, . . . , $E_n$ in FIG. 8 are of the negative sign, so that the inclination between 0 and A in FIG. 10 is determined by $e_1 = R_0/R_1/R_2/ \ldots /R_n/Rie_0$. When $e_1$ is increased to $E_{01}$, the voltage at the point $E_1$ becomes zero and the diode exhibits a cut-off characteristic, so that $R_1$ no longer acts as a feedback resistor. Thus, between A and B, $e_1 = R_0/R_2/R_3/ \ldots /R_n/Rie_0$. As the voltage $e_1$ is likewise increased thereafter, the resistors $R_1$, $R_2$, $R_3$, etc., no longer act as feedback resistors in succession and ultimately, $e_1 = R_0/Rie_0$. At this time, the inclination becomes the most approximate to upright. Therefore, in the case of a function of monotone increase or monotone decrease, any desired function may be prepared by regulating the feedback resistance values of $R_0$–$R_n$ and the voltages at the nodal points $E_1$–$E_n$. Thus, it becomes possible to prepare $y_1$ or $y_2$ of FIG. 11.

A switch SW1 and a capacitor 150 are provided to store the voltage calculated from the reflection density during the master check. Designated by 151 is an operational amplifier for increasing the input impedance. By the amplifier 151, the input impedance is increased to the gain G times, thus becoming GZi. If use is made of an FET input operational amplifier, it will be possible to provide an input impedance of the order of $10^7$–$10^{10}\Omega$. There is further provided a buffer amplifier 152, a well-known converter circuit 153 for producing an AC output in response to a LC input, and a well-known high voltage transformer 154 for rectifying a boosted AC voltage and putting out the rectified voltage.

The switch SW1 is closed when PH-A is at "H" level and PH-B at "L" level, so that the signal calculated from the density on the light portion of the master is stored in the capacitor C. When the master is moved, the switch SW1 is opened and that signal is stored until the master is replaced by the next one.

The circuit for setting the bias voltage applied to the developing device (the lower portion of FIG. 8) may also be explained in a similar manner, with the exception that there is the necessity of providing inverters before and after the function generator to effect the output of monotone decrease and the necessity of providing a bias voltage application circuit. The switch SW2 is closed when PH-A is at "L" level and PH-B is at "H" level, and it detects the density on the dark portion of the master to put out an appropriate bias voltage.

Figures 1, 13:
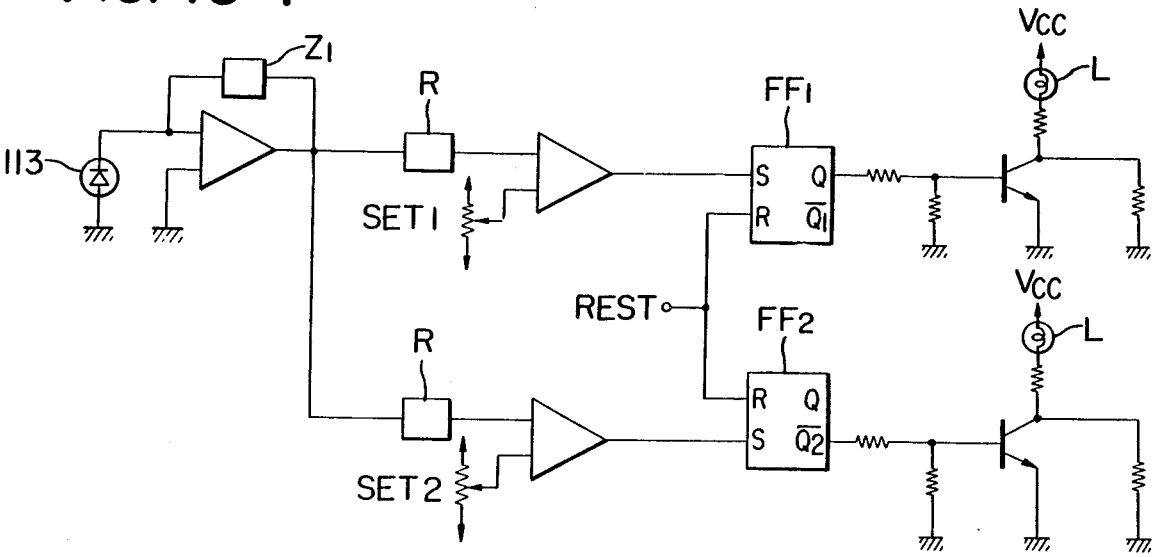

Operations of the switches SW1 and SW2 are shown in detail in the circuit of FIG. 13-2. Both of them are operated when the signals representing the detection of the cut-aways by the light emitting diode and the photodiode are produced with a time delay $\tau_1$ (to be described).

The circuit for discriminating between the limits MM1 and MM2, that is, discriminating means, is shown in detail in FIG. 13-1. $FF_1$–$FF_2$ are flip-flops for holding the outputs of the level H signal from Q terminal and the level L signal from $\overline{Q}$ terminal by the level H signal to S terminal, and for resetting these outputs by the level H signal to R terminal. Designated by L is a display lamp, that is, display means, which may be turned on by the output of FF.

In FIG. 13-2, there are AND gates G11–G14, of which the gate G13 serves to generate CPY signal which operates a relay K for executing the printing cycle. The high voltage source (HVT1, HVT2, etc.) is switched on by the relay K, and the delay signal representing the lapse of the time $\tau_2$ (to be described) after the operation of the switches SW1 and SW2 and $\overline{Q}$ signals from FF1 and FF2 are applied as input to set the flip-flop FF3. The flip-flop FF3 is reset after completion of a predetermined number of prints, or by a stop signal.

Although not shown, the control circuit 119 is reset into a stand-by condition by the print start signal STR.

Figures 2, 13, 14:
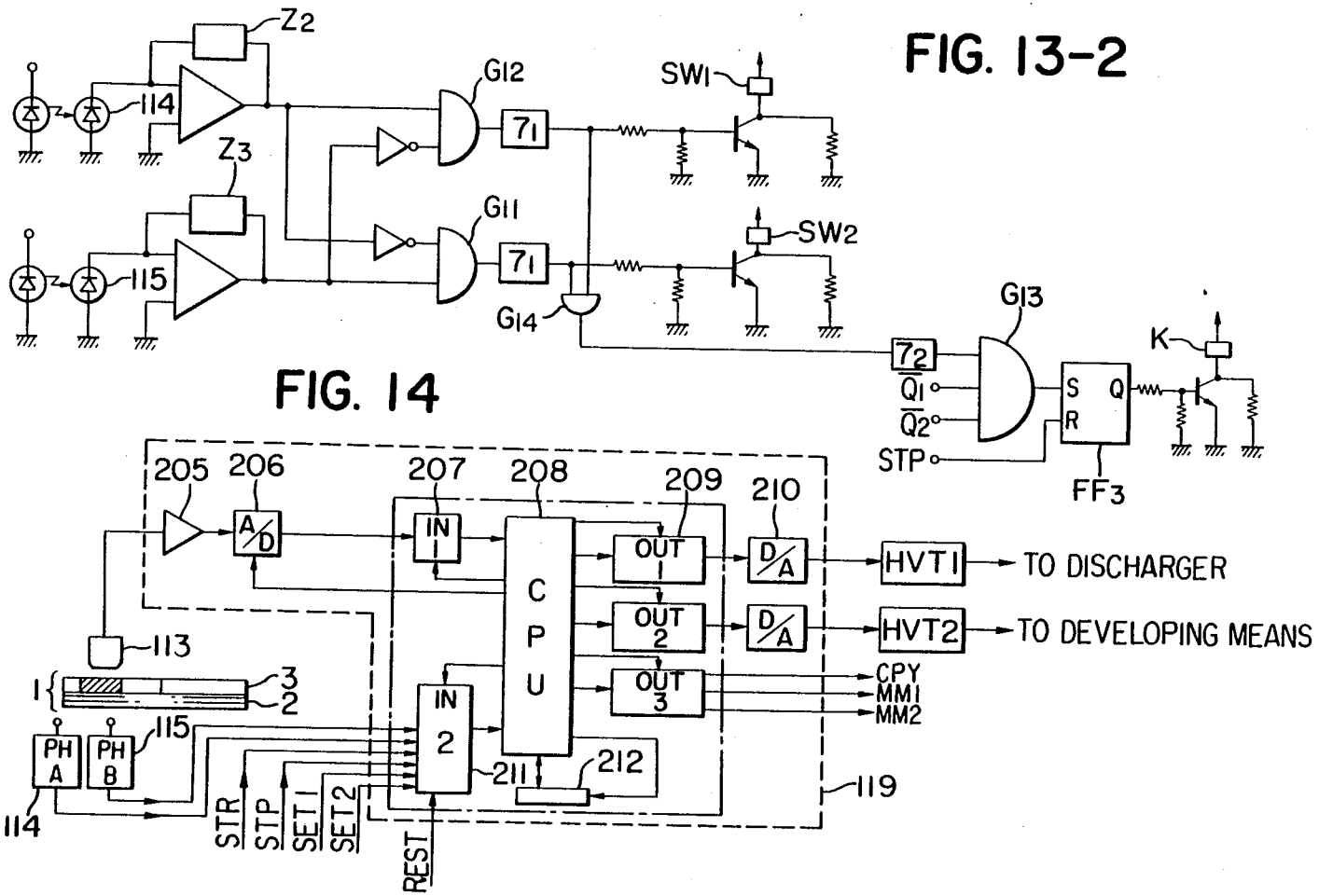
FIG. 14 diagrammatically shows a circuit using another control method according to the present invention.
Figure 15A:
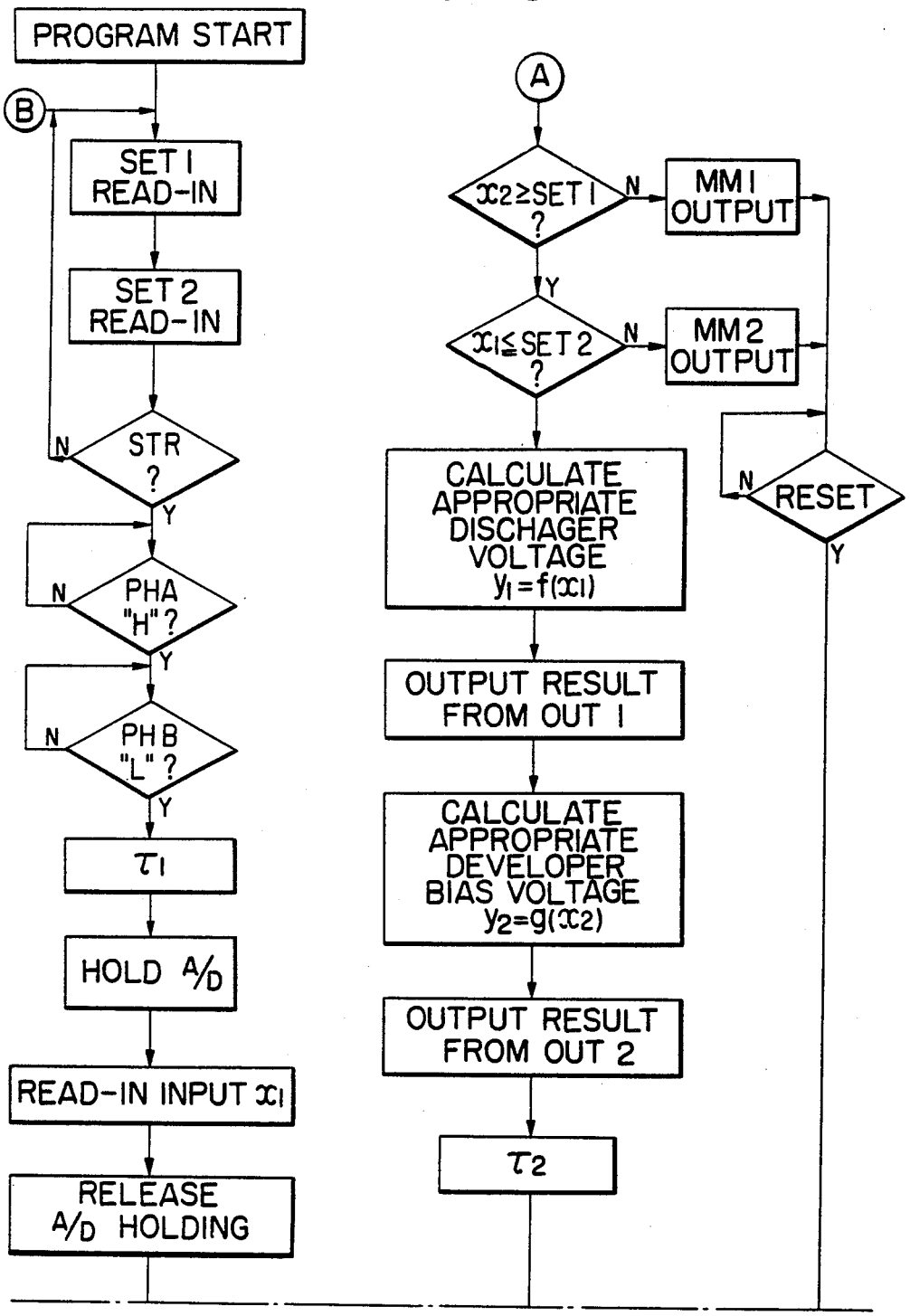
FIGS. 15A and B illustrate a flow chart for executing the method of FIG. 14.
Figure 15B:
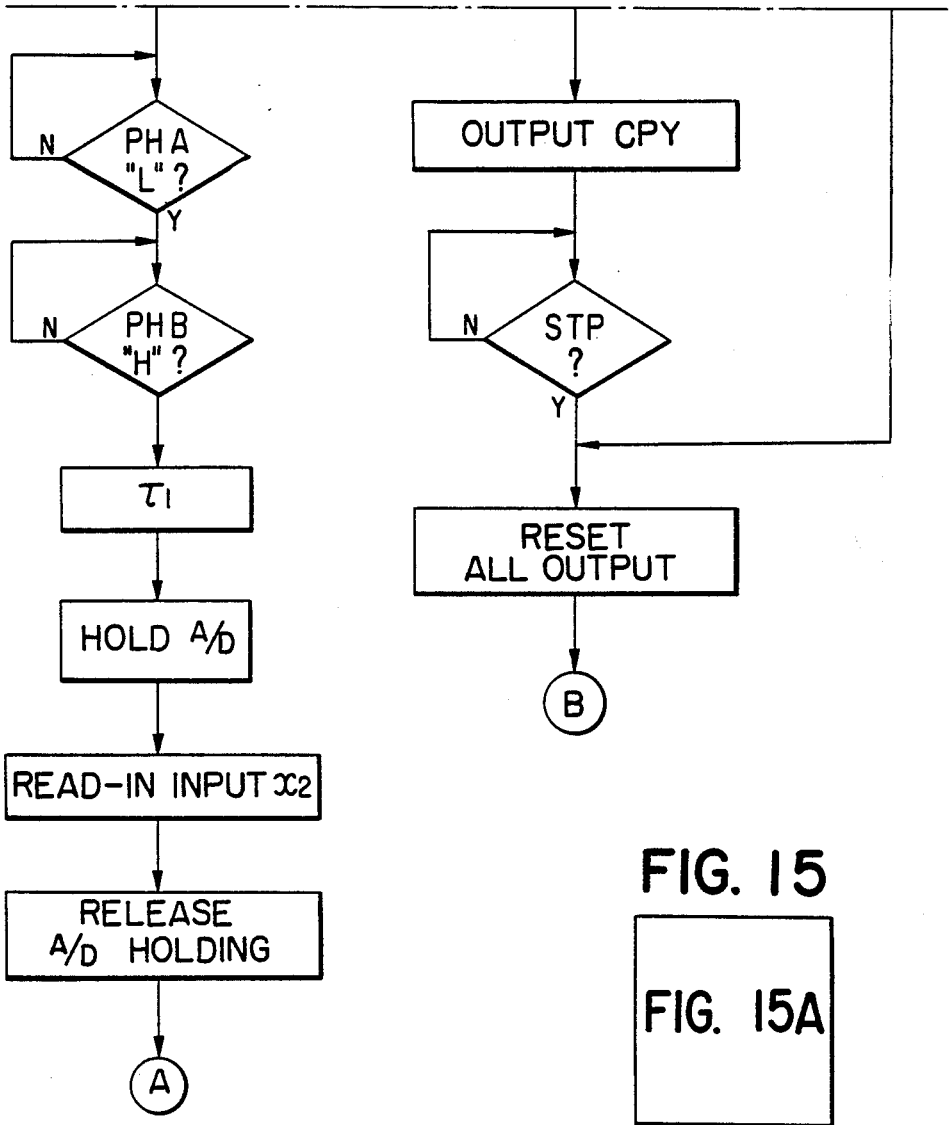
FIG. 15 is a block diagram illustrating the relative positions of FIGS. 15A and 15B.
Figure 15:
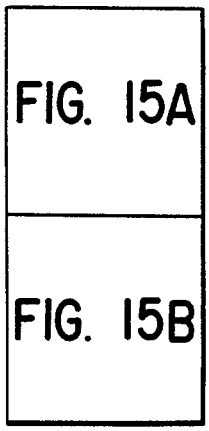

An example of the voltage control effected by a microcomputer will now be described in connection with the circuit of FIG. 14 and the flow chart of FIG. 15. When power is supplied to the printer and the automatic voltage setting control section 119, the program for flow execution stored in the memory starts to be executed and the limits of the master density are read into the memory 212 from the digital switches SET1 and SET2. The contents of the memory are revised to the latest set values by SET1 and SET2 until signal STR is supplied from the panel 120. Subsequently, the signal STR is read into the memory and when the master is moved, signals PH-A and PH-B are generated. These signals are read into CPU 208 through an input port IN2 211. Thus, when PH-A is at "H" level and PH-A is at "L" level, CPU 208 holds an A/D converter 206, which converts into a digital quantity the reflection density data value ($x_1$) of the light portion of the master detected by the detector 113 and applies the digital quantity to the memory section 212. In FIG. 15, $\tau_1$ is provided as the wait time for the density detection to take place when the light or the dark portion has come to the middle of the detector 113, and such time, like $\tau_2$ which will later be described, is determined by turning on a timer (not shown) and judging whether the timer has completed its operation. Designated by 205 is an amplifier. There is further provided an input port IN1 207 for reading in the data from the A/D converter, an input port IN2 211 for reading in signals PH-A PH-B, STR, STP, SET1, SET2 and REST, the input terminals of the input port IN2 being designated by designation signals from CPU, and a group of memory elements 212 including fixed program memories and read-in and write-in memories. These memories and the addresses therein are designated by the address designation signals from CPU, and read-in or write-in is effected in accordance with the control signal from CPU. Designated by 209 are output ports OUT1-3, of which OUT1 and 2 are connected to respective D/A converters 210 so that the digital data of the outputs may be converted into analog data. The analog outputs are applied to high voltage transformers HVT1 and HVT2 so that the output voltages can be varied in accordance with the input voltages. The output of HVT1 is applied to the charger and the output of HVT2 to the developing device. From the output port OUT3, signals CPY, MM1 and MM2 are delivered to the panel 120. These signals may remain at "H" level and may therefore be put out without being converted into analog data. These output ports are also selected by the designation signal from CPU. As soon as the detected reflection density $x_1$ of the light portion enters the memory through the A/D converter, the holding of the A/D converter is released by the next step so that the A/D converter puts out from-time-to-time detection data. The states of PH-A and PH-B are checked by the input port IN2 and when PH-A = "L" and PH-B = "H", the A/D converter again holds so that the reflection density of the dark portion of the master is now passed through the A/D converter and further through the input port IN1 and CPU 208 into the memory. The data in this case is $x_2$. After the data of the dark portion has been read in, the holding of the A/D converter is released by the program. This completes the measurement of the master density check zone. These functions may be considered, therefore, to be performed by control means.

In the next step, $x_2 \geqq$ SET1 is checked. More specifically, if the reflection density value $x_2$ of the dark portion is higher than the density limit SET1, the next step is entered. However, if $x_2 \leqq$ SET1, signal MM1 is put out from OUT3 to inform of the master density abnormality and interlock the machine so as not to enter the printing process. When $x_2$ is normal, whether $x_1 \leqq$ SET2 is checked by CPU in the next step and if $x_1 >$ SET2, signal MM2 is put out to interlock the machine in the same manner as described above. Thus, the device of the invention has prohibiting means. If $x_1$ is normal, the appropriate voltage then applied is calculated in CPU. This calculation is effected thus: the relation between the master density and the appropriate charger voltage $y_1$ or the appropriate bias voltage $y_2$ is first obtained from empirical equations $y_1=f(x)$ and $y_2=g(x)$ (see FIG. 10) with respect to several x's and the relation is stored in the memory 212, whereafter the detected densities $x_1$ and $x_2$ are compared with a predetermined x to thereby obtain $y_1$ and $y_2$ by approximation. These $y_1$ and $y_2$ are put out from the output ports OUT1 and 2, respectively. The digital data so put out from these output ports OUT1 and 2 are converted into voltages by the D/A converters 210 and applied to the high voltage transformers HVT1 and HVT2, respectively, which in turn put out the appropriate charger voltage and the developing bias voltage corresponding to the master density contrast. Next, when the step of the printing process is entered after lapse of the period $\tau_2$ during which the output voltage is stable, the master remains unchanged and therefore, a predetermined number of sheets are printed at the once set appropriate charger voltage and developing bias voltage. When the printing is completed, signal STP is generated from the main body 120 upon detection of the discharge of the last printed sheet and all the other output signals than MM1 and MM2 are reset by CPU which, therefore constitutes control means. Thereafter, the starting condition is restored. Further, if the master density is normal at the time of check of signal STP, the flow may be returned to the route for checking PH-A.

The above-described program steps enable any person skilled in the art to achieve the intended compensation and control by operating a universally used microcomputer and therefore, further finer steps following the instruction words need not be described. The present invention also enables HVT1 and HVT2 to be controlled to proper values from the density of the visible image provided during the printing process as in the case of the master. Accordingly, it will also become possible not only in the printing machines but also in the so-called copying machines to control HVT1 and HVT2 from the density of a first visible image of the original or a second visible image obtained after development, so as to provide a proper density.

According to the present invention, as has hitherto been described, the factors varying the charge retaining power may be automatically corrected by controlling the charger voltage and the developing bias voltage and this greatly contributes to enhance the stability of the printed images.

What we claim is:

1. An image formation apparatus comprising:

an electrostatically chargeable member having an optical density which changes with change of its reproducing power;

charging means for forming an electrostatic latent image on said chargeable member;

developing means for developing said electrostatic latent image into a visual image;

transferring means for transferring the visual image onto a recording member;

means for detecting the optical density before said chargeable member is charged by said charging means; and means for controlling at least one of said charging means, developing means and transferring means in accordance with an output of said detecting means.

2. An apparatus according to claim 1, wherein said chargeable member has an imaging area and an optical density checking zone whose optical density is detected by said detecting means.

3. An apparatus according to claim 2, wherein said optical density checking zone has a maximum density zone and a minimum density zone.

4. An apparatus according to claim 2, wherein said optical density detecting means detects optical density in accordance with a position of said optical density checking zone.

5. An apparatus according to claim 1, wherein said optical density detecting means detects both maximum and minimum densities.

6. An apparatus according to claim 5, wherein said control means controls at least one of said charging means, developing means and transferring means in accordance with the output for the maximum density, and controls at least one of the rest of said charging means, developing means and transferring means in accordance with the output for the minimum density.

7. An apparatus according to claim 1, wherein said chargeable member includes an organic silver salt layer.

8. An apparatus according to claim 1, wherein said detecting means detects the optical density by means of reflected light.

9. An apparatus according to claim 1, wherein said control means prevents the image forming operation of said charging means, developing means and transferring means when the output of said detecting means is within a predetermined range.

10. A recording apparatus, comprising:

an image bearing member provided with a first area having a first image reproducing power and a second area having a second image reproducing power;

means for forming an image on the image bearing member;

a single detecting means for detecting the first image reproducing power of said first area of said image bearing member and the second image reproducing power of said second area of said image bearing member and for producing detection signals indicative respectively thereof;

means for generating enabling signals indicative of when said detecting means opposes said first area and when it opposes said second area to thereby process the detection signals from said detecting means for said first and said second image reproducing powers; and control means for controlling said image forming means in dependence on the processed detection signals output from said detecting means.

11. An apparatus according to claim 10, wherein said first reproducing power is the maximum reproducing power of said image bearing member.

12. An apparatus according to claim 10, wherein said second reproducing power is the minimum reproducing power of said image bearing member.

13. An apparatus according to claim 10, wherein said detecting means detects optical densities of said first and second areas.

14. An apparatus according to claim 10, further comprising means for generating a signal when the output of said detecting means is out of a predetermined range.

15. An apparatus according to claim 14, further comprising means for stopping said apparatus when the output of said detecting means is out of the predetermined range.

16. An apparatus according to claim 15, further comprising means for making a display when the output of said detecting means is out of the predetermined range.

17. An apparatus according to claim 10, wherein said image forming means includes a charger which is controlled in accordance with said detecting means detecting said first reproducing power.

18. An apparatus according to claim 10, further comprising means for developing the image and wherein said control means controls a development bias applied to said developing means in dependence of the processed detection signals output from said detecting means for said second area.

19. An image formation apparatus for forming a visible image on a recording member, said apparatus comprising:

an image bearing member carrying a first visible image having light and dark portions;

a plurality of process means for forming a second visible image on the recording member in accordance with said first visible image;

photodetecting means comprising a light emitting portion and a light receiving portion, for photoelectrically detecting the density of the first visible image on said image bearing member;

control means for controlling said process means in accordance with an output of said photodetecting means;

discriminating means for discriminating whether the output of said photodetecting means is within a predetermined controllable range of said control means; and interlock means for preventing the operation of said process means when the output of said photodetecting means discriminated by said discriminating means is outside said range.

20. An apparatus according to claim 19, further comprising means for displaying the output of said discriminating means.

21. An apparatus according to claim 19, wherein said control means includes means for releasing the preventing function of said interlock means.

22. An apparatus according to claim 19, wherein said photodetecting means detects an optical density of said image bearing member.

23. An apparatus according to claim 19, wherein said image bearing member includes an area for image formation, and a checking zone where the density of the first image is detected.

24. An apparatus according to claim 19, wherein said image bearing member includes an organic silver salt layer.

25. An image formation apparatus for forming an image on a recording member, said apparatus comprising:

an image bearing member carrying a first visible image having light and dark portions;

a plurality of process means for forming a second visible image on the recording member member in accordance with the first visible image;

photodetecting means comprising a light emitting portion and a light receiving portion, for photoelectrically detecting the density of the first visible image on said image bearing member;

an analog-digital converter for converting an output of said photodetecting means to a digital signal; and control means having a program memory, for processing said digital signal and generating a control signal for controlling said process means, said control means holding said analog-digital converter during read-in operation of said photodetecting means, of the density of the first image, and after a predetermined period of time, releasing the operation of said analog-digital converter.

26. An apparatus according to claim 25, wherein said control signal is a digital signal, said apparatus further comprising digital-analog means for converting the digital signal into an analog signal which controls said process means.

27. An apparatus according to claim 25, wherein said program control means controls the operation of said analog-digital converter means.

28. An image formation apparatus for forming a visible image on a recording member, said apparatus comprising:

an image bearing member carrying a first visible image having light and dark portions;

a plurality of process means for forming a second visible image on the recording member in accordance with the first visible image;

photodetecting means comprising a light emitting portion and a light receiving portion, for photoelectrically detecting the density corresponding to the first visible image on said image bearing member;

control means for controlling said process means in accordance with an output of said photodetecting means;

discriminating means for discriminating whether the output of said detecting means is within a predetermined controllable range of said control means; and display means for displaying that an output of said photodetecting means is outside of said range.

29. An image forming apparatus for forming a visible image on a recording member, said apparatus comprising:

an image bearing member carrying a first visible image having light and dark portions;

a plurality of process means for forming a second visible image on the recording member in accordance with the first visible image;

detecting means for detecting the density of said visible first image on said image bearing member;

control means for controlling an operable condition of said process means on the basis of at least one of the output from said detecting means and a limit value; and setting means for setting the limit value for the density as detected by said detecting means, said limit value being adjustable.

30. An image forming apparatus for forming a visible image on a recording member, said apparatus comprising:

an image bearing member carrying a first visible image having light and dark portions;

a plurality of process means for forming a second visible image on the recording member in accordance with the first visible image;

detecting means for detecting the density of the first visible image on said image bearing member; and control means for controlling an operable condition of said process means on the basis of the output from said detecting means, said control means providing limit values for the density detected by said detecting means and said limit values corresponding respectively to a light density and a dark density.

31. An image forming apparatus for forming a visible image on a recording member, said apparatus comprising:

an image bearing member carrying a first visible image having light and dark portions;

a plurality of process means for forming a second visible image on the recording member in accordance with the first visible image;

detecting means comprising a light emitting portion and a light receiving portion, for photoelectrically detecting the density of the first visible image; and control means for holding a control signal corresponding to an output of said detecting means until the completion of a predetermined number of repeated image formations by said process means and for controlling an operable condition of said process means in accordance with the control signal held thereby.

* * * * *

UNITED STATES PATENT AND TRADEMARK OFFICE

CERTIFICATE OF CORRECTION

PATENT NO. : 4,734,740

DATED : March 29, 1988

INVENTOR(S) : MOTOHARU FUJII, ET AL.

It is certified that error appears in the above-identified patent and that said Letters Patent is hereby corrected as shown below:

COLUMN 1

Line 29, "sing" should read --using--.
Line 61, "unable" should read --usable--.

COLUMN 2

Line 4, "pathalte," should read --phthalate,--.
Line 7, "methylhydroxynaphthalens," should read --methylhydroxynaphthalene,--.
Line 9, "4,4'-butylidone" shoud read --4,4'-butylidene--.
Line 21, "$Al_2X_2$, $MnX_2$," should read --$Al_2X_2$, $ZnX_2$, $MnX_2$,--.
Line 40, "resis," should read --resin,--.

COLUMN 3

Line 19, "matters." should read --matter.--.
Line 40, "stepping" should read --stopping--.

COLUMN 4

Line 24, "B" should read --15B--.
Line 35, "designate" should read --designates--.
Line 45, "photogrphic" should read --photographic--.

UNITED STATES PATENT AND TRADEMARK OFFICE

CERTIFICATE OF CORRECTION

PATENT NO. : 4,734,740

DATED : March 29, 1988

INVENTOR(S) : MOTOHARU FUJII, ET AL.

It is certified that error appears in the above-identified patent and that said Letters Patent is hereby corrected as shown below:

COLUMN 5

Line 32, "cl EXAMPLE 1" should read --EXAMPLE 1-- (centered).

Line 35, "sill" should read --mill--.

Lines 54-59, "

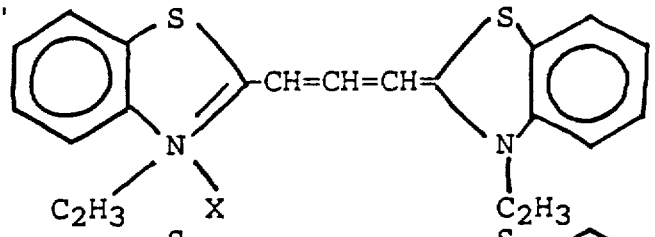

"

should read --

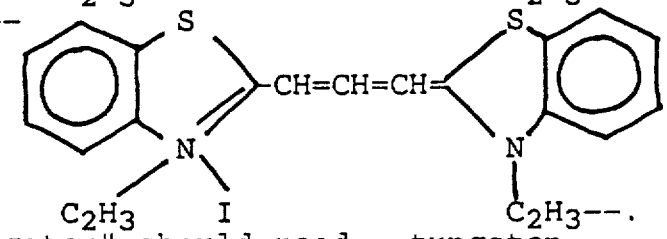

--.

Line 65, "tungstem" should read --tungsten--.

COLUMN 7

Line 38, "on" should read --of--.

COLUMN 8

Line 66, "R1 144," should read --$R_i$ 144,--.

UNITED STATES PATENT AND TRADEMARK OFFICE

CERTIFICATE OF CORRECTION

PATENT NO. : 4,734,740

DATED : March 29, 1988

INVENTOR(S) : MOTOHARU FUJII, ET AL.

It is certified that error appears in the above-identified patent and that said Letters Patent is hereby corrected as shown below:

COLUMN 9

Line 7, "$e_1=R_0/R_1/R_2 \ldots /R_n/Rie_0$"
should read

-- $$e_1=\frac{R_0/R_1/R_2 \ldots /R_n}{R_i}e_0$$ --.

Line 11, "$e_1=R_0/R_2/R_3 \ldots /R_n/Rie_0$"
should read

-- $$e_1=\frac{R_0/R_2/R_3 \ldots /R_n}{R_i}e_0$$ --.

Line 14, "$e_1=R_0/Rie_0$."
should read

-- $$e_1=\frac{R_0}{R_i}e_0$$ --.

Line 32, "LC" should read --DC--.

UNITED STATES PATENT AND TRADEMARK OFFICE

CERTIFICATE OF CORRECTION

PATENT NO. : 4,734,740

DATED : March 29, 1988

INVENTOR(S) : MOTOHARU FUJII, ET AL.

It is certified that error appears in the above-identified patent and that said Letters Patent is hereby corrected as shown below:

COLUMN 14

Line 12, "member member" should read --member--.

Signed and Sealed this

Twenty-first Day of February, 1989

*Attest:*

DONALD J. QUIGG

*Attesting Officer*

*Commissioner of Patents and Trademarks*